343-872 SR
5/2/78 XR 4,087,820

United States Patent [19]

Henderson

[11] 4,087,820

[45] May 2, 1978

[54] COLLAPSIBLE-HELIX ANTENNA

[76] Inventor: Albert L. Henderson, 920 Runnymead La., San Diego, Calif. 92106

[21] Appl. No.: 765,650

[22] Filed: Feb. 4, 1977

[51] Int. Cl.[2] ..... H01Q 1/36

[52] U.S. Cl. ..... 343/752; 343/872; 343/895

[58] Field of Search ..... 343/895, 752, 872

[56] References Cited

U.S. PATENT DOCUMENTS

| | | | |
|---|---|---|---|
| 3,510,872 | 5/1970 | Mullaney | 343/895 |
| 3,836,979 | 9/1974 | Kurland et al. | 343/895 |
| 3,858,220 | 12/1974 | Arnow | 343/895 |

FOREIGN PATENT DOCUMENTS

| | | | |
|---|---|---|---|
| 810,325 | 10/1936 | France | 343/895 |

*Primary Examiner*—Eli Lieberman
*Attorney, Agent, or Firm*—Laurance E. Banghart

[57] ABSTRACT

A collapsible-helix antenna, continuously variable in length and self-resonant with a uniform resistance over an exceedingly wide frequency range, for example 2–32 mHz. The collapsible-helix is continuous in two sections: a fixed-length, shorted-out section wherein the turns of the helix are collapsed upon each other; and a variable-length section wherein the helix has an approximately constant pitch, and is a radiating element. Means are provided to drive turns of the helix from either section to the other, providing a helix with continuously variable physical and electrical length.

4 Claims, 12 Drawing Figures

COLLAPSIBLE-HELIX ANTENNA

BACKGROUND OF THE INVENTION

This invention relates to helical antennas wherein the diameter of the helix is short compared with the wavelength of the radiated signal. The helix is very long compared with its diameter, and substitutes for a wire, a pipe, or a tower as a radiating element. The directivity pattern is essentially the same in any case. The radiating element, to be resonant, must have an "electrical" length that is an appreciable fraction of a wavelength of the radiated signal, generally ¼ to ½ the wavelength.

Any straight radiating element has an electrical length only slightly longer than its physical length. A helix has an electrical length much longer than its physical length. The helical radiating element can thus be considerably shorter than an equivalent straight radiating element. This feature is particularly important when the frequency of the radiated signal is below 50 mHz and radiating elements are necessarily long, requiring considerably space and costly supporting structure.

This invention further relates to antennas wherein the electrical length is adjusted to be resonant at the frequency of the radiated signal. Antennas of this type are called self-resonant antennas, and are distinguishable from fixed-length antennas wherein the system must include an auxiliary coupling device to match the antenna to the rest of the system.

Finally this invention relates to antennas that are continuously variable in electrical length. Continuously variable antennas are distinguishable from antennas that are tapped with several switchable electrical lengths. U.S. Pat. No. 3,179,941 is typical of the switched-length, helical antenna art.

Prior art has used helices that are continuously variable in electrical length U.S. Pat. No. 2,948,894 and U.S. Pat. No. 3,623,113). However, the helices of prior art have fixed dimensions, are wound around dielectric forms, and are thus not collapsible. At minimum frequency the fixed-dimension helix radiates over its entire length. At higher frequencies, portions of the helix are shorted-out with a straight element, reducing the electrical length of the shorted-out portion to the electrical length of the shorting element. It is apparent that a fixed-dimension helix has a resonant frequency range limited approximately to the ratio of the electrical length of the helix to the physical length of the helix.

SUMMARY OF THE INVENTION

A fundamental object of this invention is to provide a collapsible-helix antenna with a continuously variable physical and electrical length, self-resonant with a uniform resistance over a very wide frequency range. The example to be described is a 35 foot antenna that is self-resonant, by changing length, from 2 mHz to 32 mHz.

The collapsible-helix is continuous in two sections: a fixed-length, shorted-out section wherein the turns of the helix are collapsed upon each other; and a variable-length section wherein the helix has an approximately constant pitch, and is a radiating element. Means are provided to drive turns of the helix from either section to the other, providing a helix with continuously variable physical and electrical length. The fixed-length section is long enough to contain the completely collapsed helix, and has a constant electrical length only slightly longer than its physical length. The variable-length section has an electrical length approximately 4½ times its physical length.

Adjusting the length of the radiating element provides resonance at the frequency of the radiated signal, but the antenna resistance at resonance will vary considerably over the frequency band if means are not provided to keep it constant. This would result in poor efficiency due to mismatch with the system and to excessive losses in the ground resistance. This invention avoids these problems by a novel use of top loading. A cylindrical metallic pipe is attached to the end of the helix as a top load and the top 10 feet, approximately, of the guy ropes are metallic to provide a parasitic top load.

Another object of this invention is to configure the helix so that its length and pitch can be changed elastically over a very wide range with very little force, while considerable force is necessary to distort the helical shape. This object is accomplished by the helix having a cross sectional width (perpendicular to the longitudinal axis of the helix) considerably larger than the cross sectional height (parallel with the axis of the helix). This kind of helix is called an "edge-wound" helix.

Another object of this invention is to provide a positive mechanical means to continuously drive turns of the helix from either section of the helix to the other, while providing a constant pitch to the helix in the variable-length section. In the preferred embodiment this is provided by: (1) collapsibly interconnecting the inner edges of each turn of the helix to limit the maximum pitch of the helix; (2) eliminating slack in the variable-length section of the helix with a motor-driven windlass, lanyard, and pulley combination; and (3) driving the turns of the helix from either section to the other, as a screw is driven, with a rotating, helical-groove drive collar. The drive collar is driven synchronously with the windlass, and by the same motor.

Another object of this invention is the elimination of dielectric forms around which helical radiating elements have been wound. Forms create physical problems by distorting, and electrical problems by supporting corrosion, with the attendant leakage and loss of radiation efficiency.

Another object of this invention is to provide a self-supporting, plastic enclosure that is air-tight and is filled with dry nitrogen to eliminate corrosion. An internal heating element is provided, when appropriate, to prevent the formation of ice on the mast.

This invention will be described in terms of an antenna for use in the 2–32 mHz band, but the features of this invention are not limited to that band.

Antennas in the 2–32 mHz band are generally vertical, and this invention will be described in terms of a vertical antenna. While vertical antennas are of primary interest, the invention is not limited to vertical antennas.

The "Marconi" antenna is the prevalent form of vertical antenna. The electrical drive is applied between the lower end of a vertical radiator that is near a ground plane, and the ground plane. For resonance the length of the vertical radiator must be approximately one-quarter the wavelength of the radiated signal. The ground plane may be the earth, the sea, the top of an automobile, or the deck of a boat. This invention will be described in terms of the "Marconi" antenna, and will be equally effective in the other vertical antenna configurations.

BRIEF DESCRIPTION OF THE DRAWINGS

The invention will be better understood by reference to the following figures in which.

DETAILED DESCRIPTION

Figure 1:
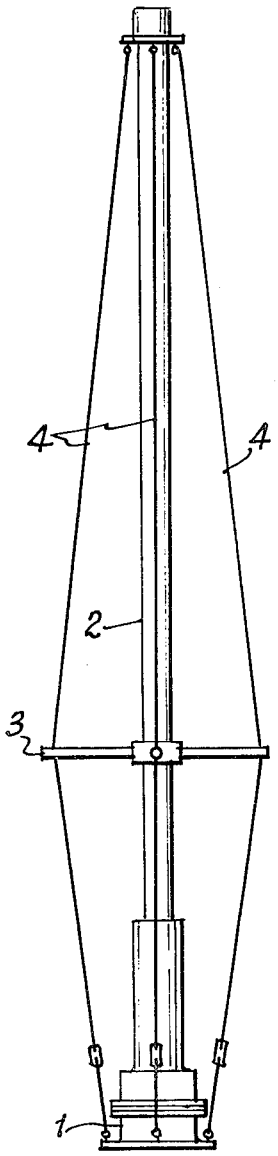
FIG. 1 is an elevation view of an antenna typical of this invention.

Referring now to FIG. 1, an elevation view of an antenna, typical of this invention, is shown. The lower enclosure 1 houses mechanical drive components and, when appropriate, a heating element. It makes electrical contact with the ground plane. The plastic mast 2 is cylindrical and is transparent to the radiation from the antenna radiating elements inside the mast. The mast, with its spars 3 and guy ropes 4, is self-supporting. The top 10 feet, approximately, of the guy ropes are metallic and act as a parasitic top load. The lower portions of the guy ropes are fiberglass.

With modern high-strength composite materials, such as epoxy-bonded fiberglass, a mast in excess of 35 feet is practical. The mast protects the radiating elements and the mechanical drive components from moisture and supports a pulley at its top. The pulley is part of the drive system.

With this configuration it becomes practical to make the mast and the lower enclosure air-tight, so that dry nitrogen can become the atmosphere inside the antenna, virtually eliminating corrosion of the internal elements. An internal heating element is provided, when appropriate, to prevent the formation of ice on the mast.

Figure 2:
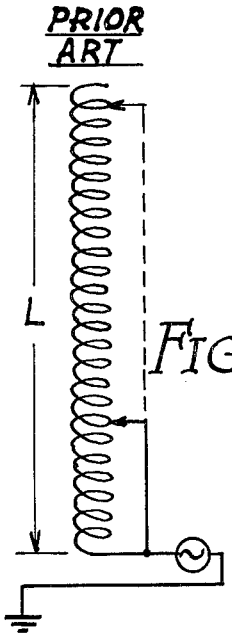
FIG. 2 is a schematic representation of prior art, a fixed-dimension helix with a variable-length, straight, shorting element.

FIG. 2 is a schematic representation of a fixed-dimension helix with a variable-length, straight, shorting element. This is prior art. The minimum electrical length is approximately equal to the maximum physical length length of the antenna, L, because in this case L equals the maximum length of the shorting element. The maximum electrical length is L times the factor by which the helix increases its electrical length over its physical length. For this, and the following, examples a typical factor of 4.5 will be assumed. The possible variation in electrical length is thus 4.5 : 1 for this antenna.

Figure 3:
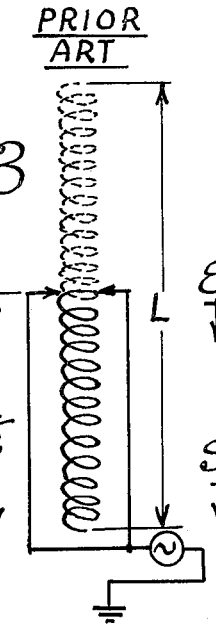
FIG. 3 is a schematic representation of prior art, a fixed-dimension helix that is variably driven into and out of a fixed-length, straight, shorting element.

FIG. 3 is a schematic representation of a fixed-dimension helix wherein the helix is variably driven into and out of a fixed-length, straight, shorting element. This also is prior art. The maximum physical length of the antenna is again L, and the length of both the helix and the shorting element is L/2. The minimum electrical length is L/2 and the maximum electrical length is $L/2 + 4.5(L/2) = 2.75L$. The possible variation in electrical length is thus 5.5 : 1.

Figure 4:
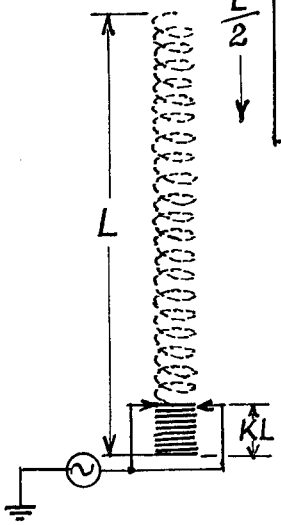
FIG. 4 is a schematic representation of the collapsible helix antenna of this invention.

FIG. 4 is a schematic representation of the collapsible helix of this invention. The minimum electrical length is KL, where L is again the maximum physical length of the antenna and K is the ratio of the length of the collapsed helix to the length of the helix fully extended. The maximum electrical length is $KL + (1-K)\,4.5L = L(4.5-3.5K)$. The possible variation in electrical length is thus 37 : 1.

The extreme variation in electrical length of this invention translates directly into an exceedingly wide range of self-resonant frequencies. Table I compares the maximum and minimum self-resonant frequencies of the three helices described above for a "Marconi" antenna of various maximum physical lengths.

TABLE I

| Antenna physical length (max.) | | FIG. 2 antenna freq. (mHz) | | FIG. 3 antenna freq. (mHz) | | FIG. 4 antenna freq. (mHz) | |
|---|---|---|---|---|---|---|---|
| meters | feet | min | max | min | max | min | max |
| 12 | 39.4 | 1.4 | 6.3 | 2.3 | 12.5 | 1.5 | 56.3 |
| 10.7 | 35 | 1.6 | 7.0 | 2.6 | 14.1 | 1.7 | 63.3 |
| 10 | 32.8 | 1.7 | 7.5 | 2.7 | 15.0 | 1.8 | 67.5 |
| 8 | 26.3 | 2.1 | 9.4 | 3.4 | 18.8 | 2.3 | 84.4 |
| 6 | 19.7 | 2.8 | 12.5 | 4.6 | 25.0 | 3.1 | 113 |
| 4 | 13.1 | 4.2 | 18.8 | 6.8 | 37.5 | 4.6 | 169 |

The 2–32 mHz frequency band is exceedingly important in radio communications, and 35 feet is a practical economical limit for self-supporting antennas. It is apparent from Table I that this invention is particularly suited to these requirements. For this reason the invention is described in terms of a 35 foot antenna, self-resonant from 2 mHz to 32 mHz.

Figure 5:
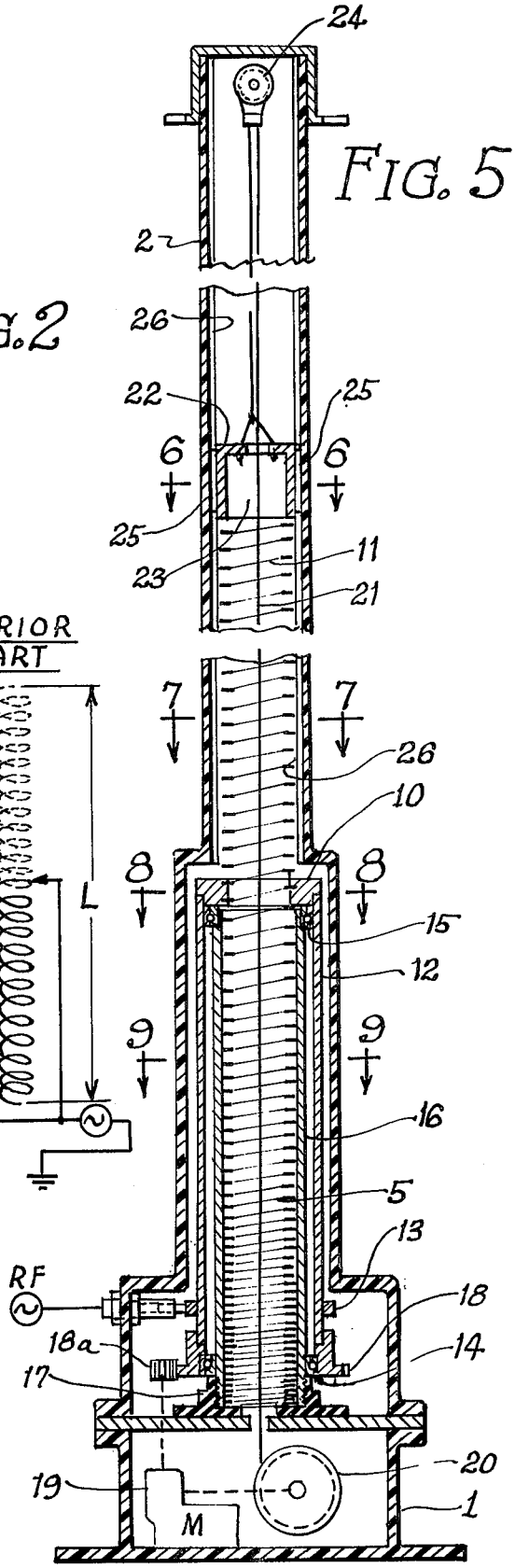
FIG. 5 is an elevation-section view of the antenna of FIG. 1, taken to include the longitudinal axis of the antenna.

FIG. 5 is an elevation section view of an antenna typical of this invention. The collapsed portion of the helix 5 is shown below the drive collar 10, and the variable length portion of the helix 1 is shown above the drive collar. An outer pipe 12, from slip ring 13 to drive collar 10, is the straight shorting element already discussed. The outer pipe is a radiating element regardless of the length of the helix.

Figure 10:
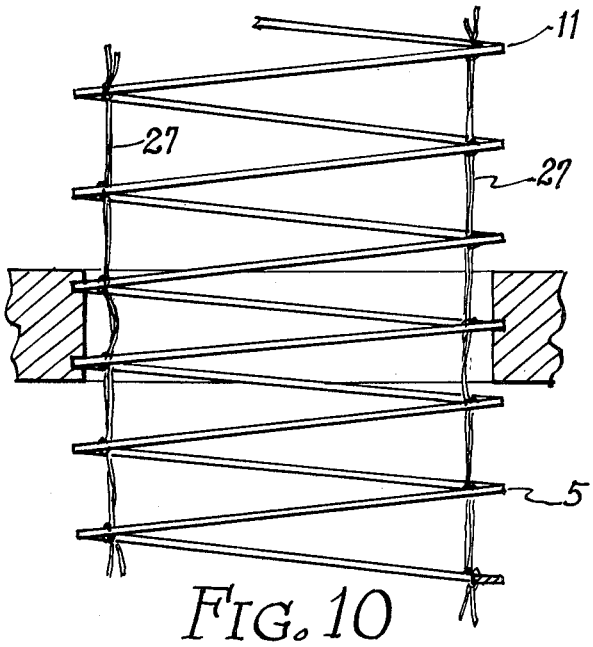
FIG. 10 is a detailed, perspective view of the helix as it passes through the drive collar which is shown in section.
Figure 7:
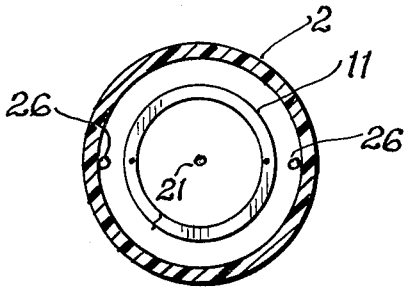
FIG. 7 is a detailed, plan-section view of the antenna, taken approximately on the line 7—7 of FIG. 5.
Figure 8:
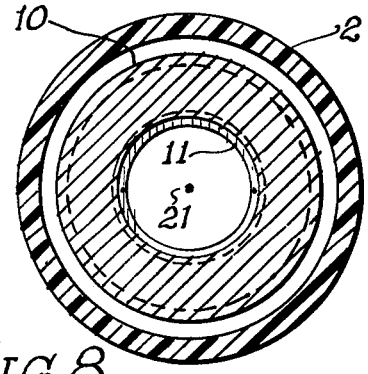
FIG. 8 is a detailed, plan-section view of the antenna, taken approximately on the line 8—8 of FIG. 5.
Figure 9:
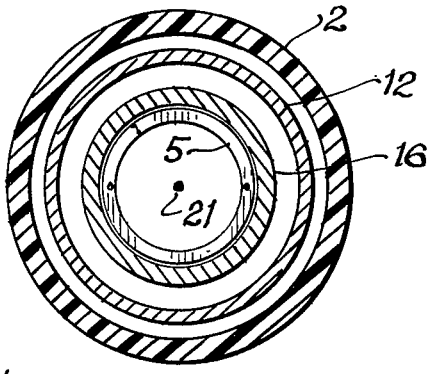
FIG. 9 is a detailed, plan-section view of the antenna, taken approximately on the line 9—9 of FIG. 5.

The drive collar is rigidly fixed to the outer pipe and has a helical groove (approximately 1½ turns) that contains and drives the outer edges of 1½ turns of the helix. FIGS. 8 and 10 are helpful in visualizing this. As the outer pipe and drive collar are rotated, turns of the helix are driven either upward into the variable length portion of the helix or downward into the collapsed portion, depending on the direction of rotation.

The outer pipe is rotatably supported 14 and 15 by an inner pipe 16. The inner pipe also supports the collapsed portion of the helix and does not rotate. The helix is connected to the inner pipe to prevent rotation of the helix. The inner pipe is supported by being rigidly fastened to a base insulator 17 and does not rotate.

Near the bottom of the outer pipe, the signal to be radiated contacts the outer pipe by means of a slip ring 13. Just below the slip ring is a gear 18 around the periphery of the pipe. A motor-driven gear-train 19 drives this gear, on command, to vary the length of the helix. The gear train also drives a windlass 20. The windlass variably takes in or lets out a lanyard 21. The other end of the lanyard is attached to the metallic top load 22, which in turn is rigidly fastened to the top of the helix. The lanyard extends from the windlass, up through the mast, through a hole in the top load 23, around the pulley 24, and down to the top load.

The windlass and lanyard are driven synchronously with the drive collar, and keep the helix at a relatively constant pitch in the variable length section. Without the lanyard, the helix would collapse, in the variable length section, just due to its own weight.

The invention is equally useful whether the motor drive is part of an automatic (or semi-automatic) control system or is commanded by a manual switch. The gear train also drives limit switches, to prevent the mechanism from driving beyond mechanical limits, and an electrical pickoff device to detect the length of the helix. An indicating meter, driven electrically by the pickoff device, has dial markings in terms of resonant frequency. These components, with the exception of the meter, are housed in the lower enclosure 1 along with the motor, gear train, and windlass.

An automatic control system detects voltage standing wave ratio (V.S.W.R.) and provides drive signals to the motor, changing the length of the helix to minimize V.S.W.R. A semi-automatic control system provides proper helix length by generating motor drive signals from the difference between commanded length and actual length as detected by the pickoff device.

Figure 6:
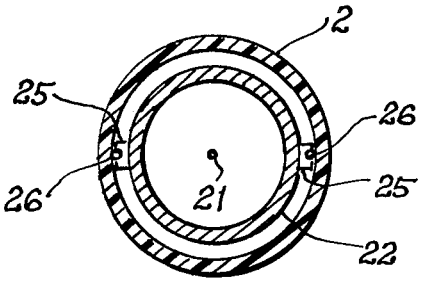
FIG. 6 is a detailed, plan-section view of the antenna, taken approximately on the line 6—6 of FIG. 5.

FIG. 6 is a section view through the metallic top load 22. The view shows top-load tabs 25 on each side of fiberglass ropes 26. The ropes are bonded inside the mast longitudinally from just above the drive collar 10 to near the top of the mast. The purpose of this is to prevent the top load from rotating as it travels up and down.

Figure 12:
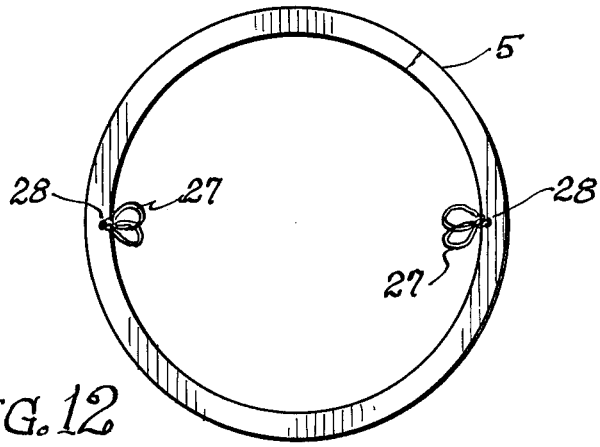
FIG. 12 is a detailed, plan view of the collapsed helix.

FIG. 10 is a section view of the helix and drive collar, and shows that, in the preferred embodiment, the turns of the helix are collapsibly tied together with dacron (or similar) yarn 27 passed through small holes in the turns of the helix 28 of FIG. 12. This limits the maximum pitch the helix can have in spite of gravity, friction, and any imperfections in synchronization between the windlass and the drive collar.

Figure 11:
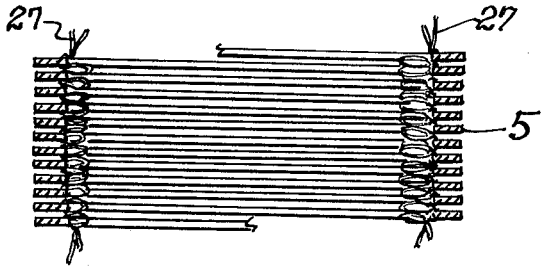
FIG. 11 is a detailed, elevation-section view of the collapsed helix.

FIG. 11 is a section view of the collapsed helix showing that the dacron yarn collapses inwardly, not interfering with the collapse of the helix.

FIG. 12 is a plan view of the helix showing, along with FIG. 11, the edge-wound nature of the helix: the helical element being much wider than it is high.

In low-cost embodiments of this invention the dacron yarn could be omitted and, so long as the antenna is vertical, the drive collar could be replaced by a contacting, sliding collar. This would not provide a reliably constant pitch in the helix but could be acceptable in some cases.

What I claim is:

1. A collapsible-helix antenna comprising: a helix of many turns, long compared with its diameter, and greatly expandible in length and pitch; means for separating the helix into two sections, the first of which is fixed in length and shorted-out wherein the turns of the helix are collapsed upon each other, the second of which is continuously variable in length wherein the helix has an approximately constant pitch and is a radiating element; a motor-driven helical-groove drive collar to drive the turns of the helix from either of said sections of the helix to the other section and a lanyard, pulley, windlass combination, driven by said motor, to provide a constant pitch to the helix in the variable length section as the length of the helix is continuously varied.

2. A collapsible-helix antenna as claimed in claim 1 wherein the turns of the helix are collapsibly tied together with fibrous yarn passed through small holes near the inside of the turns of the helix, limiting the maximum pitch of the helix.

3. A collapsible-helix antenna as claimed in claim 2 wherein a uniform resistance at resonance is provided by the combination of a metallic cylindrical top load and metallic guy wires as a parasitic top load.

4. A collapsible-helix antenna as claimed in claim 3 wherein the antenna is air tight and filled with a dry gas.

* * * * *